US007983439B2

(12) United States Patent
Bruckhoff et al.

(10) Patent No.: US 7,983,439 B2
(45) Date of Patent: Jul. 19, 2011

(54) HEADSET FOR FITTING OF AN EARPIECE

(75) Inventors: Henning Bruckhoff, Gappsen (DE); Evert Dijkstra, Fontaines (CH)

(73) Assignee: Bruckhoff Apparatebau GmbH, Hannover (DE)

( * ) Notice: Subject to any disclaimer, the term of this patent is extended or adjusted under 35 U.S.C. 154(b) by 311 days.

(21) Appl. No.: 12/285,470

(22) Filed: Oct. 6, 2008

(65) Prior Publication Data

US 2009/0103765 A1 Apr. 23, 2009

Related U.S. Application Data

(63) Continuation of application No. PCT/DE2007/000607, filed on Apr. 3, 2007.

(30) Foreign Application Priority Data

Apr. 4, 2006 (DE) ..... 10 2006 016 052

(51) Int. Cl.
*H04R 25/00* (2006.01)

(52) U.S. Cl. ..... 381/381; 381/375

(58) Field of Classification Search ..... 381/374, 381/375, 381; 379/428.01, 430, 431
See application file for complete search history.

(56) References Cited

U.S. PATENT DOCUMENTS

| | | | | |
|---|---|---|---|---|
| 4,039,765 | A * | 8/1977 | Tichy et al. | 379/430 |
| 6,097,827 | A * | 8/2000 | Yang | 381/375 |
| 6,396,935 | B1 | 5/2002 | Makkonen | |
| 2004/0208335 | A1 | 10/2004 | Gleissner | |

FOREIGN PATENT DOCUMENTS

| | | | |
|---|---|---|---|
| DE | 32 33 375 | A1 | 3/1984 |
| DE | 201 05 562 | U1 | 8/2001 |
| DE | 101 39 865 | A1 | 4/2003 |
| DE | 10139865 | A1 * | 4/2003 |
| DE | 102 27 450 | B4 | 11/2004 |
| DE | 10 2005 002 482 | B3 | 6/2006 |
| GB | 2 036 505 | A | 6/1980 |
| WO | WO 2006/076892 | A | 6/1980 |
| WO | WO 02/054825 | A | 7/2002 |

OTHER PUBLICATIONS

International Search Report dated Jul. 31, 2007 in PCT application No. PCT/DE2007/000607, filed Apr. 3, 2007 (3 pages).
Patent Abstract of Japanese publication No. JP 58 136199 A, published Aug. 13, 1983 (1 page).
Machine Translation of DE 201 05 562 U1 from http://epo.worldlingo.com/wl/epo/epo.html, dated Dec. 22, 2008, 2 pages.
Webpage www.wikipatents.com/jp/2004135280.html, dated Dec. 29, 2008, 3 pages.

* cited by examiner

*Primary Examiner* — Brian Ensey
(74) *Attorney, Agent, or Firm* — Shlesinger, Arkwright & Garvey LLP

(57) ABSTRACT

Headset for fitting an earpiece that has a lock housing in or on which a fixing device is provided. A flexurally rigid and elastic ear loop which forms a loop for accommodating the outer ear of a user, and one end of the ear loop is received longitudinally displaceable in the fixing device of the lock housing, and for adjusting the size of the loop is adjustably received in various length positions, creating a fixing effect. There is a control device for receiving and outputting electrical signals and a signal interface for receiving and/or outputting electrical signals to and/or from the control device.

22 Claims, 5 Drawing Sheets

HEADSET FOR FITTING OF AN EARPIECE

CROSS-REFERENCE TO RELATED APPLICATIONS

This application is a continuation of application no. PCT/DE2007/000607, filed Apr. 3, 2007, which claims the priority of German patent application no. 10 2006 016 052.5, filed Apr. 4, 2006, and each of which is incorporated herein by reference.

FIELD OF THE INVENTION

The invention relates to a headset, in particular for a hearing device, in order to fit an earpiece or for a hearing device mounting.

BACKGROUND OF THE INVENTION

Known among hearing devices are hearing tube systems in which sound signals are conducted through a hearing tube into the auditory canal from a housing earpiece of a BTE (behind-the-ear) hearing device. In addition, external hearing systems are known that are placed e.g. directly into the auditory canal.

In all of the systems it is difficult to fit the system to the ear of the user. In addition, as a rule also fitting further functional devices is very complex.

Moreover, headsets for attaching microphones to the head of the user are known. Using them it is possible for the user to provide voice input into the microphone without having to hold the microphone with his hands.

As a rule, such headsets have a curved unit that is placed over the head, similar to headphones, and that, due to its elasticity, clamps the headset to the head. These can be used e.g. by singers during live performances or by deployed forces, e.g. the police, for communication purposes.

However, such headsets are complex, cumbersome, and can have a negative impact on aural reception. Moreover, they negatively affect the visual appearance of the person and also interfere with wearing additional head gear.

Conventional fixation of a functional device using hanging ear units, etc., on the outer ear generally does not ensure stable, slip-resistant attachment with which the functional device can be positioned from the outer ear e.g. as a microphone in the area of the mouth of the user.

DE 102 27 450 B4 depicts a headset for a functional device, in particular a microphone, in which the insert body is inserted into the concha or auditory canal of the user and fixed using a clamping ear unit that is clamped on the concha. A holding device is attached to the insert body and bears the attached functional device, e.g. a rigid wire unit.

Headsets are furthermore used in the field of medicine for applying transformers for cochlear implants. These headsets can have a bending element and an otoplastic to be placed in the ear such as is described e.g. in DE 201 05 562 U1.

U.S. Pat. No. 6,396,935 B1 depicts a headset having a rigid, bendable retention unit, a microphone and speaker being provided at the ends of the retention unit. The retention unit is placed about the outer ear of the user and has in its interior a transmitter/receiver device for mutual communication with e.g. a portable device in a shirt pocket.

OBJECTS AND SUMMARY OF THE INVENTION

An object of the invention is to overcome the drawbacks of the prior art.

Another object of the invention is to create a headset that assures secure positioning of a microphone on the head of the user.

This object is achieved in accordance with the invention using a headset for fitting an earpiece, the headset including (a) a lock housing in or on which a fixing device is provided; (b) a flexurally rigid and elastic ear loop forming a loop for accommodating the outer ear of a user; (c) one end of the ear loop being received longitudinally displaceably in the fixing device of the lock housing and the one end being received adjustably in various length positions for adjusting the size of the loop and achieving a fixing effect; (d) a control device for receiving and outputting electrical signals; and (e) a signal interface for receiving and/or outputting electrical signals to and/or from the control device. Further preferred embodiments are described below.

An idea underlying the invention is to attain fastening using a loop that is placed about the outer ear or the auricle, including the earlobe, and the size of which can be securely adjusted using a fixing element.

In accordance with the invention, an ear loop runs from the lock housing rearward and upward further towards the back, is placed over the outer ear and is guided on the front the outer ear through the lock housing in which a fixing element secures or fixes the loop at the desired length. Thus a loop is formed that can be placed about the outer ear.

The lock housing receives the ear loop coming from above at e.g. an acute angle, i.e. less than a right angle, or even at approximately a right angle.

In accordance with one embodiment, the end of the ear loop to be placed as a retention unit behind the outer ear runs forward through the lock housing and bears on its end the functional device to be positioned, i.e. in particular a microphone. In this case the longitudinal position of the lock housing is adjusted relative to the retention unit.

In accordance with another embodiment, the end of the ear loop that is to be placed in front of the outer ear runs rearward through the lock housing as a tensioning element, i.e. in particular as a tensioning unit or tensioning pull, so that the longitudinal position of the lock housing is adjusted relative to the retention unit.

In accordance with the invention, the earpiece can be a housing earpiece that conducts sound signals directly into the user's auditory canal via an acoustic tube.

Alternatively, the earpiece can also be an external earpiece that is to be positioned in the area of the concha, i.e. in the concha or in the auditory canal, the lock housing, preferably the control device of the lock housing, then being connected to the external earpiece via an electrical line.

The signals can be forwarded via an output line and/or using wireless signals.

The control device can receive, process (e.g. amplify), and forward the signals. However, fundamentally it can also simply pass on signals, i.e. act as a contact; such an embodiment makes sense in particular when a line is connected to an external transmitter and/or receiver, because in this case no power amplification is required.

Moreover, a powerful amplifier can be provided in the microphone, the signal lines being shielded against induction, e.g. as a coaxial cable or twisted pair line. In this case, as well, the control device can merely forward the signals without processing them.

The fixing device can in particular be a clamping element that receives the retention unit e.g. in a through-hole or eyelet.

Moreover, other types of fixing are also possible, e.g. form-fit and/or with a securing element such as e.g. a screw or pin.

The loop has a certain outward internal stress and thus is not constricting. The loop advantageously forms an oval shape with one tip at the lock housing thus accommodates the outer ear in an anatomically favorable manner. The angle at the fixing element is advantageously an acute angle, i.e., smaller than a right angle, in order to attain good tensioning or clamping, or it can even be approximately a right angle. This embodiment is surprisingly self-correcting and self-centering.

According to the invention it is understood that the elastic ear loop, which is flexurally rigid (i.e. at its flex points it has a certain internal stiffness with no slack resilience) and is placed on top over the outer ear and at the front runs downward, has a certain flexural stress that pulls the fixing element or the fixing device forward and upward. Thus the fixing device can be embodied as a simple eyelet that can be displaced in the longitudinal direction as desired by the user with a little force on the retention unit, the eyelet being inclined, without additional fixing means, due to the flexural stress of the ear loop, such that the longitudinal position is secured. During manual adjustment, in general the user can grasp the retention unit in front of the fixing element with one hand and with the other hand can grasp the ear loop above the fixing element and displace it in the longitudinal direction, even weaker persons being able to tolerate the force required for this.

Clamping can be attained simply from a slight difference in the interior diameter of the eyelet and the exterior diameter of the retention unit. The diameters can be largely the same so that displacement is possible due to the elasticity of the outer shell of the retention unit and the tilting described above effects additional securing. Moreover, the control device can represent a slide stop for the clamping element slipping to the rear so that constriction of the outer ear during very careless adjustments is prevented.

In accordance with one preferred embodiment, one or a plurality of individual wires that can be twisted or not twisted run in the retention unit and in the ear loop. Such individual wires having an outer shell surrounding them enable adjustment that holds it shape, has a certain elasticity, and is free of restoring force when the elasticity is overcome. In accordance with the invention the one or a plurality of individual wires of the retention unit and ear loop can be embodied continuous, i.e. they run from the functioning device to the fixing element, and they can run in or adjacent to the signal interface. Thus the retention unit and the ear loop can inventively transition into one another. They can also be embodied in a single piece; such an embodiment is particularly advantageous when combined or integrated with fixing element and signal interface so that a continuous unit can run from the functional device to the signal interface. In the signal interface the signal lines can then be e.g. conducted through to e.g. a line that runs downward.

Uniform stiffness and elasticity of the loop is assured in the continuous embodiment of the one or plurality of individual wires through the retention unit and the ear loop. It has been demonstrated that specifically this embodiment enables slip-resistant fastening that for the user is pleasant, non-interfering, and non-constricting.

The electrical lines that run between the functional device and the signal interface can advantageously be received between the (e.g. twisted) individual wires of the retention unit. This attains in addition a rounder shape for the bundle made of individual wires and electrical lines so that subsequently, by coating with a thin outer shell made of plastic or rubber, a round shape is attained that can be received without significant clearance by an eyelet having a round cross-section.

The inventive headset does not clog the auditory canal; it is hygienically acceptable because it is not affixed in the auricle or outer ear. It can be used for both the left ear and the right ear because it does not have a preferred left or right side.

As an alternative to the embodiment having rigid individual wires, the retention unit and/or the ear loop can also be embodied e.g. as plastic injection-molded parts or the retention unit can be embodied by coating the signal lines.

The invention is described in greater detail in the following using the enclosed drawings of a few embodiments.

DETAILED DESCRIPTION OF THE INVENTION

Figure 1:
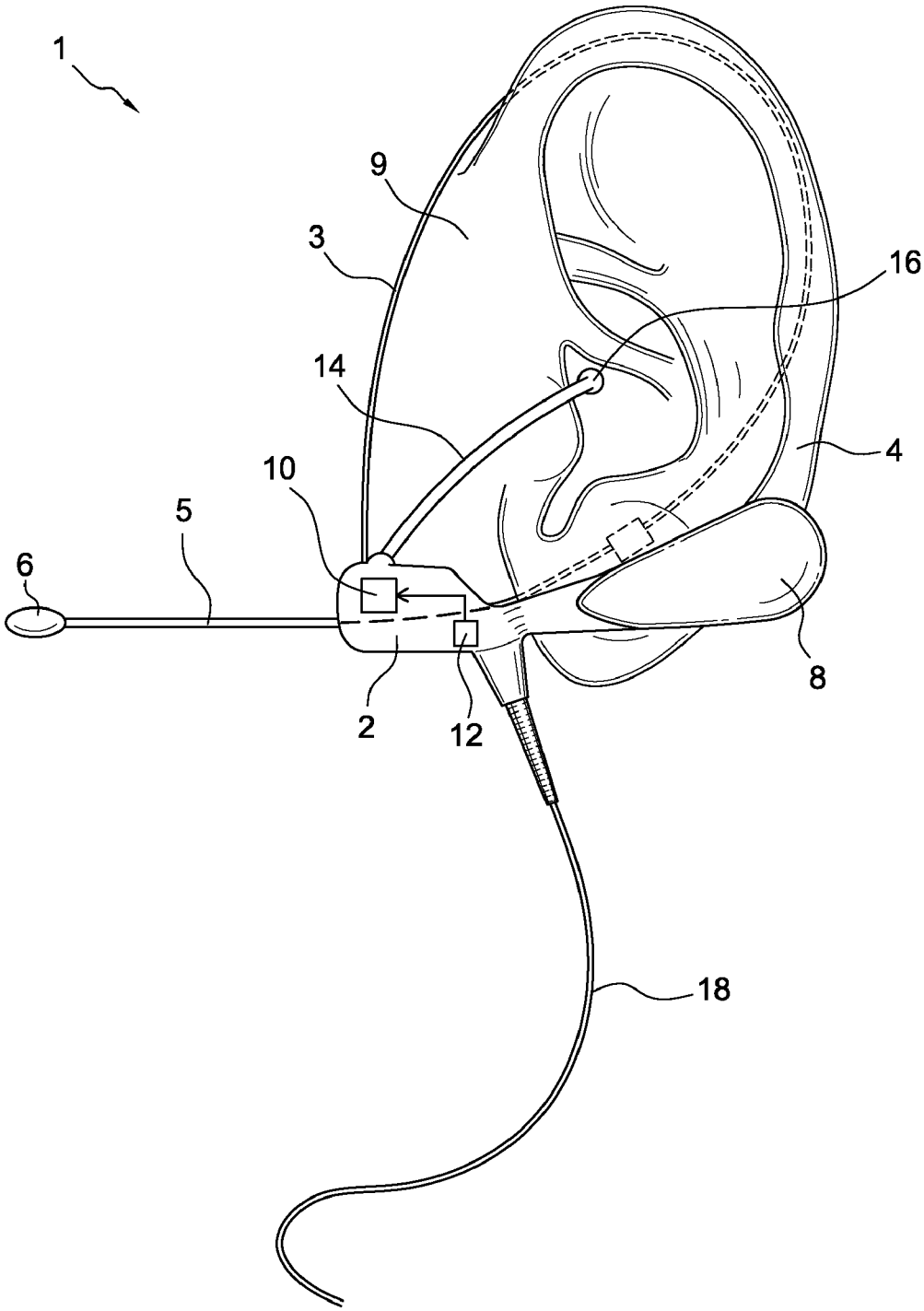
FIG. 1 is a side view of an inventive headset in accordance with a first embodiment having an acoustic tube, microphone holder, and connecting line to a pocket transmitter, worn on the outer ear of a user.

In accordance with the various embodiments, a headset 1 has a lock housing 2 to which is attached an ear loop 3 that is made of a rigid, bendable, elastic material and that forms a loop 9. For ease of visualization, the loop 9 in FIG. 1 is placed about the outer ear 4 of a user. One end of the ear loop 3 is securely received on or in the lock housing 2, and the other end is guided through the lock housing 2 for adjusting the size of the loop 9.

In FIG. 1 the end of the ear loop 3 coming from behind is guided forward through the lock housing 2 and acts as a long, rigid or flexurally rigid, bendable retention unit 5 that can be adjusted in its flex points with no restoring force and that projects forward and at the end of which is attached a microphone 6 acting as a functional device. This attachment and orientation occurs in the same manner on either side of the user, i.e. on the user's left or right outer ear 4. The retention unit 5 and the ear loop 3 advantageously have approximately the same stiffness and elasticity so that when adapted to the outer ear 4 approximately conforming curvature of these areas results; preferably the loop 9 forms a largely oval shape having an acute angle between lock housing 2 and retention unit 5. Advantageously retention unit 5 and ear loop 3 are made of one continuous strand of material. A line is guided from the microphone 6 through the retention unit 5 and the ear loop 3 to the lock housing 2. Thus the microphone 6 and the lock housing 2 are arranged on opposed ends of the retention unit 5, the lock housing 2 having a fixing device that receives the retention unit 5 longitudinally displaceable and that can be adjusted in the longitudinal positions along the retention unit 5 while creating a fixing effect. The fixing effect can be e.g. a clamping force so that the fixing device is a clamping device; alternatively, however, there can also be a different fixing effect, e.g. using a form fit or an added securing means, e.g. a screw that has been tightened, etc. The fixing effect is advantageously releasable and reversible so that re-adjustment is possible. The size of the loop 9 can thus be adjusted in a stepless manner.

FIG. 1 depicts the inventive headset 1 fitted on the outer ear 4 of a user. To place it, the lock housing 2 is also initially adjusted to a forward position on the retention unit 5, i.e. closer to the microphone 6. The adjustment occurs such that the loop 9 is large enough to be placed over the outer ear 4 without the user having to fold his outer ear 4 forward too much in order to force it into the loop 9.

The loop 9 is placed about the outer ear 4 such that the ear loop 3 is situated below the concha and advantageously runs under the earlobe and with the microphone 6 projects forward at its front end. Starting from the control device 2, the ear loop 3 initially extends upward behind the outer ear 4, then runs forward over the outer ear 4, then from there downward to the lock housing 2, so that the ear loop 3 meets the retention unit 5 at a largely right angle at the lock housing 2. By displacing the lock housing 2 relative to the retention unit 5, the user can then adjust a suitable position in which a secure hold is created using the loop 9, and the user can also orient the microphone 6 by bending the retention unit 5 into a suitable position.

In the embodiments a wireless receiver 8 can be provided, on the lock housing and installed in a fixed manner or attachable.

Moreover, an earpiece for transmitting sound waves is provided, a mountable earpiece 10 that receives electrical control signals from a control device 12 and outputs sound waves into the auditory canal 16 of the user via an attached acoustic tube 14 made e.g. of silicone being provided in FIG. 1 in the lock housing 2. The acoustic tube 14 is placed on the lock housing 2, can be changed separately, and can be adjusted to various lengths.

The control device 12 can draw the electrical control signals directly from the receiver 8 or can include signals received from the microphone 6.

Moreover, in the embodiment in FIG. 1, connected to the lock housing 2 is a line 18 via which received sound signals are sent to a pocket transmitter (not shown).

Fundamentally, in FIG. 1 the receiver 8 can also be omitted, the signals to be transmitted via the earpiece then being sent to the control device 12 via the line 18.

Figure 2:
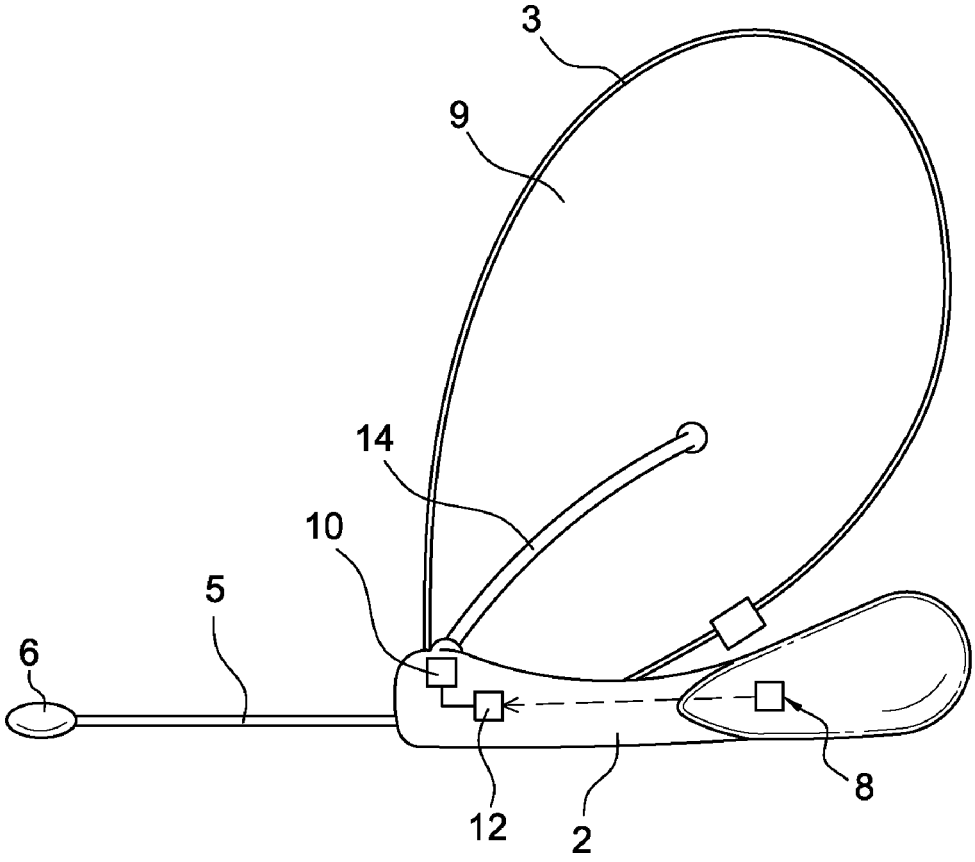
FIG. 2 depicts a headset in accordance with another embodiment, without a connecting line to the pocket transmitter.

No line 18 is provided in the embodiment in FIG. 2, transmitter, receiver, and mountable earpiece 10 thus being accommodated in the lock housing 2. In this case, e.g. a combined transmitter/receiver device 8 can be provided, The embodiment in FIG. 3 has been modified compared to FIG. 2 in that the end of the right, rear half of the ear loop 3 of the loop 9 is securely accommodated on the lock housing 2 and the other, left front end is displaceably guided through the lock housing 2 and can be fixed continuously at different lengths using a fixing element. This left, front end is thus guided rearward as a tensioning unit 20 or tensioning wire 20 having an end piece 21, e.g. a ball 21.

Figure 3:
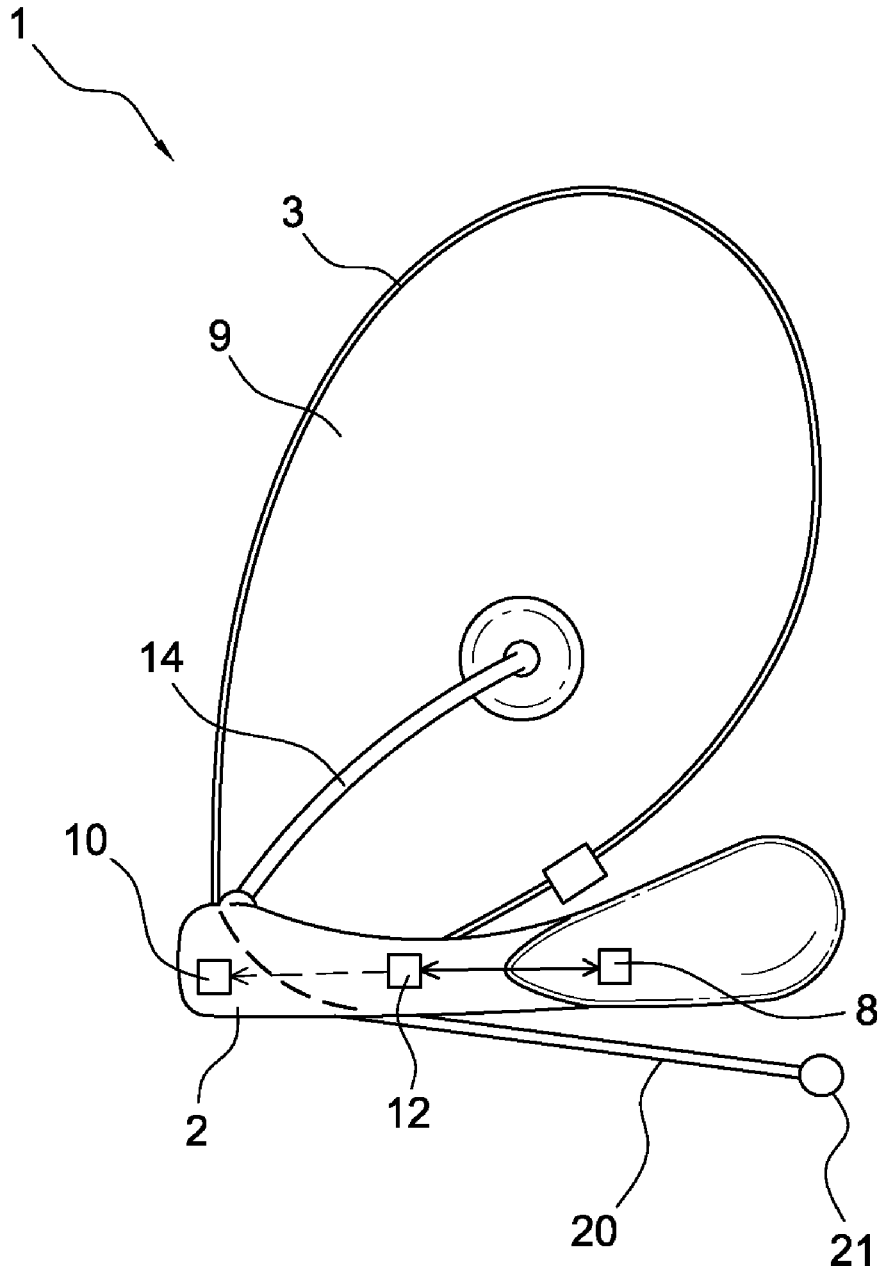
FIG. 3 depicts a headset in accordance with another embodiment, having a tensioning wire instead of the microphone holder.

The size of the loop 9 is adjusted in that the user displaces the lock housing 2 relative to the tensioning unit 20 projecting rearward. FIG. 3 can be combined with FIG. 1 in that in FIG. 3 a line 18 runs out from the lock housing 2 to an external transmitter, e.g., a pocket transmitter.

Figure 4:
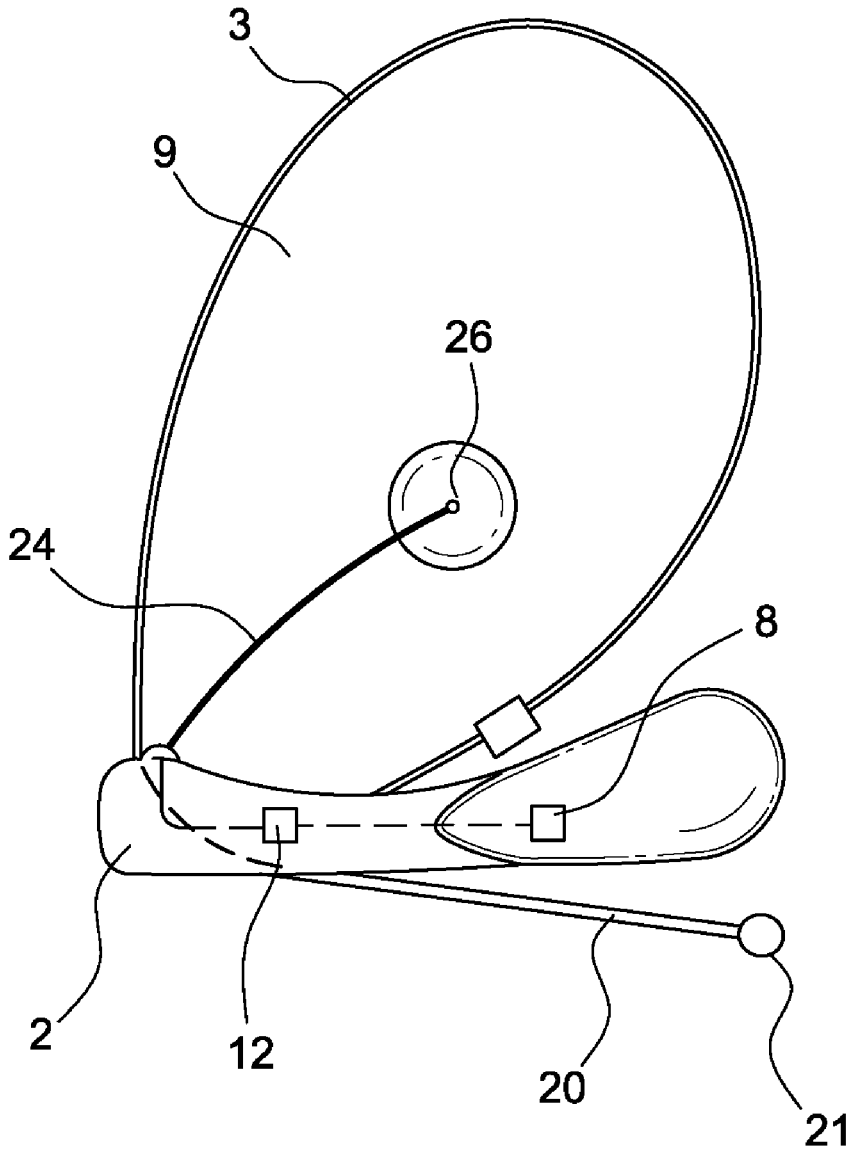
FIG. 4 depicts a headset in accordance with another embodiment, having an external earpiece instead of an acoustic tube.

FIG. 4 depicts another embodiment that has been modified with respect to FIG. 3 in that, instead of a mountable housing earpiece, an external earpiece 26 is provided that is to be placed in the auditory canal or in the concha. The control device 12 transmits electrical signals to the external earpiece 26 via an electrical line 24.

Figure 5:
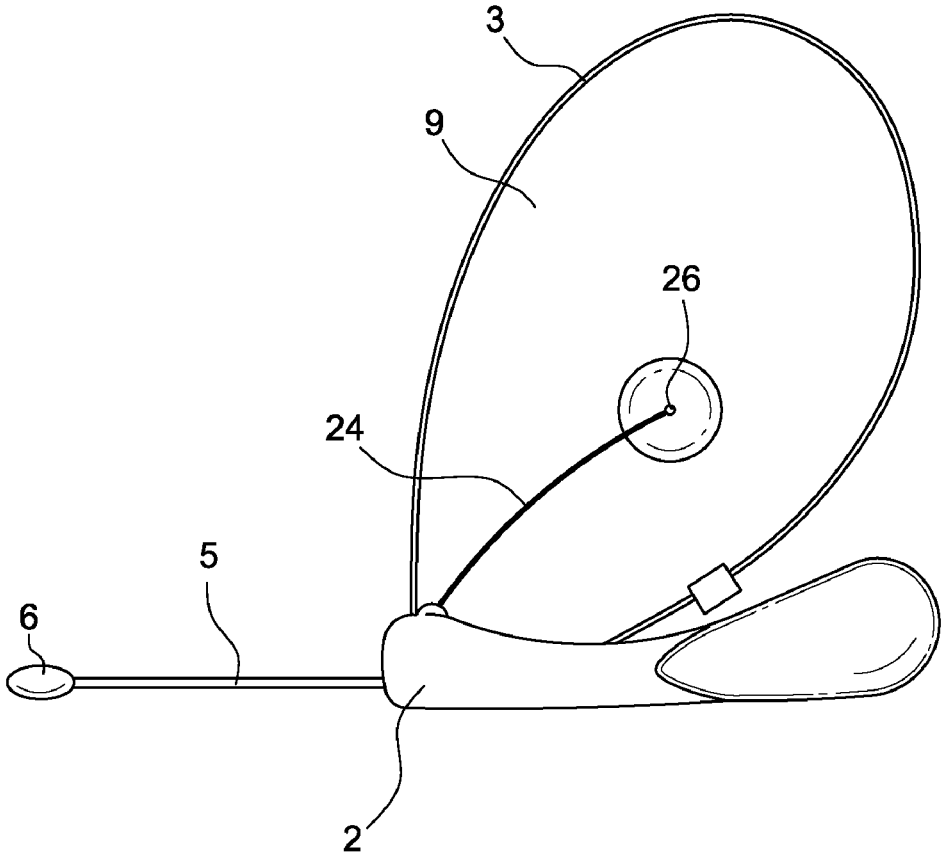
FIG. 5 depicts a headset in accordance with another embodiment, which compared to FIG. 4 has a microphone holder instead of the tensioning wire.

FIG. 5 depicts a combination of the embodiment in FIG. 4 with that of FIG. 2, in which a front retention unit 5 that has a microphone 6 and instead of the tensioning unit 20, is guided through the lock housing 2 as the length-adjustable element.

In the embodiments, e.g. Bluetooth signals can be used for wireless signals.

Thus fundamentally any desired data communication from the headset 1 to external devices is possible. In addition to the medical field for hearing aids, it is thus also possible to use the invention for other applications, e.g. voice input and output in the field of entertainment or for telephone services, e.g. call centers, as hands-free devices in motor vehicles, during television broadcasts, etc.

The ear loop 3 can be produced from e.g. wire, i.e. one or a plurality of individual wires, where necessary including a signal line, or from a rigid, elastic plastic or rubber material.

The fixing element can in particular be a clamping element. A clamping force that can be manually overcome can be exerted on the ear loop (3). This can be created e.g. in that the clamping element has an eyelet through which the ear loop 3 runs, creating clamping force. The clamping element can tilt due to the effect of a bending moment with the eyelet exerted by the ear loop 3.

Alternatively, the fixing element can be fixable in a form fit, e.g. using a screw connection.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. Headset for fitting an earpiece, comprising:

a) a lock housing in or on which a fixing device is provided;

b) a flexurally rigid and elastic ear loop forming a loop for accommodating the outer ear of a user;

c) one end of the ear loop being received longitudinally displaceably in the fixing device of the lock housing and the one end being received adjustably in various length positions for adjusting the size of the loop and achieving a fixing effect;

d) a control device for receiving and outputting electrical signals;

e) a signal interface for receiving and/or outputting electrical signals to and/or from the control device; and f) the end of the ear loop guided in front of the outer ear being longitudinally displaceable and transitions into a tensioning unit or tensioning wire extending out from the lock housing.

2. Headset in accordance with claim 1, wherein:

a) the end of the ear loop guided behind the outer ear is longitudinally displaceable and transitions into an adjustable retention unit that projects forward from the lock housing, is flexurally rigid, bendable, and free of restoring force in its bending positions, for positioning a functional device attached thereto, electrical signal lines running from the functional device through the retention unit and the ear loop to the control device in the lock housing.

3. Headset in accordance with claim 2, wherein:
a) the ear loop and the retention unit have substantially the same elasticity.
4. Headset in accordance with claim 2, wherein:
a) the ear loop and the retention unit are embodied as continuous loops.
5. Headset for fitting an earpiece, comprising:
a) a lock housing in or on which a fixing device is provided;
b) a flexurally rigid and elastic ear loop forming a loop for accommodating the outer ear of a user;
c) one end of the ear loop being received longitudinally displaceably in the fixing device of the lock housing and the one end being received adjustably in various length positions for adjusting the size of the loop and achieving a fixing effect;
d) a control device for receiving and outputting electrical signals;
e) a signal interface for receiving and/or outputting electrical signals to and/or from the control device;
f) an earpiece is provided, the earpiece being configured for receiving electrical signals from the control device and for transmitting sound waves; and
g) lines extend from the lock housing to an external earpiece that is to be attached to the concha or in the auditory canal.
6. Headset in accordance with claim 1, wherein:
a) the tensioning unit or tensioning wire extends rearward from the lock housing.
7. Headset in accordance with claim 1, wherein:
a) an earpiece is provided, the earpiece being configured for receiving electrical signals from the control device and for transmitting sound waves.
8. Headset in accordance with claim 7, wherein:
a) a housing earpiece is provided in the lock housing; and
b) the housing earpiece outputs sound waves to an acoustic tube which is attached to the lock housing and that is for being used in the auditory canal of the user.
9. Headset in accordance with claim 8, wherein:
a) the acoustic tube is exchangeably attached to the lock housing.
10. Headset in accordance with claim 1, wherein:
a) lines extend from the lock housing to an external earpiece that is to be attached to the concha or in the auditory canal.
11. Headset in accordance claim 1, wherein:
a) when attaching to the outer ear the ear loop runs rearward starting from the lock housing below its ear lobe, upward behind the outer ear, forward over the outer ear, and downward again in front of the outer ear back to the lock housing.
12. Headset in accordance with claim 1, wherein:
a) at least one output line extends from the lock housing to an external transmitter and/or receiver device.
13. Headset in accordance with claim 1, wherein:
a) a transmitter and/or receiver device is provided accommodated in or placed on the lock housing, and the transmitter and/or receiver device is for wireless signals and is connected to the control device.
14. Headset in accordance with claim 13, wherein:
a) the transmitter and/or receiver device is removably placed on the lock housing.
15. Headset in accordance with claim 1, wherein:
a) the ear loop is embodied as a bendable wire loop that holds its shape and has one or a plurality of individual wires or is produced from a rigid, elastic plastic or rubber material.
16. Headset in accordance with claim 1, wherein:
a) the fixing device is a clamping element.
17. Headset in accordance with claim 16, wherein:
a) the clamping element clamps the ear loop with a clamping force that can be overcome manually.
18. Headset in accordance with claim 17, wherein:
a) the clamping element has an eyelet through which the ear loop runs with clamping force being exerted.
19. Headset in accordance with claim 18, wherein:
a) the clamping element inclines under the effect of a bending movement exerted on the retention unit through the ear loop with the eyelet.
20. Headset in accordance with claim 1, wherein:
a) the fixing device can be fixed in a form fit by creating a screw connection.
21. Headset in accordance with claim 5, wherein:
a) the end of the ear loop guided in front of the outer ear is longitudinally displaceable and transitions into a tensioning unit or tensioning wire extending out from the lock housing.
22. Headset for fitting an earpiece, comprising:
a) a lock housing in or on which a fixing device is provided;
b) a flexurally rigid and elastic ear loop forming a loop for accommodating the outer ear of a user;
c) one end of the ear loop being received longitudinally displaceably in the fixing device of the lock housing and the one end being received adjustably in various length positions for adjusting the size of the loop and achieving a fixing effect;
d) a control device for receiving and outputting electrical signals;
e) a signal interface for receiving and/or outputting electrical signals to and/or from the control device;
f) a transmitter and/or receiver device is provided accommodated in or placed on the lock housing, and the transmitter and/or receiver device is for wireless signals and is connected to the control device; and
g) the transmitter and/or receiver device is removably placed on the lock housing.

* * * * *